US009132987B2

(12) United States Patent
Castillo et al.

(10) Patent No.: US 9,132,987 B2
(45) Date of Patent: Sep. 15, 2015

(54) APPARATUS WITH ROTATABLE ARM FOR UNWINDING STRANDS OF MATERIAL

(75) Inventors: Mario Castillo, Cincinnati, OH (US); Nicholas Goyette, West Chester, OH (US)

(73) Assignee: The Procter & Gamble Plaza, Cincinnati, OH (US)

( * ) Notice: Subject to any disclaimer, the term of this patent is extended or adjusted under 35 U.S.C. 154(b) by 525 days.

(21) Appl. No.: 13/289,199

(22) Filed: Nov. 4, 2011

(65) Prior Publication Data

US 2013/0112794 A1 May 9, 2013

(51) Int. Cl.
*B65H 57/20* (2006.01)
*B65H 57/14* (2006.01)

(52) U.S. Cl.
CPC ..... *B65H 57/20* (2013.01); *B65H 57/14* (2013.01); *B65H 2701/31* (2013.01)

(58) Field of Classification Search
CPC ..... B65H 57/14; B65H 57/20; B65H 2701/31
USPC ..... 242/566, 128, 593, 594, 594.5, 594.6, 242/597, 615.3, 147 M, 156, 157 R, 242/131–131.1
See application file for complete search history.

(56) References Cited

U.S. PATENT DOCUMENTS

| | | | | |
|---|---|---|---|---|
| 1,459,694 | A | 6/1923 | Holder | |
| 1,547,596 | A | 7/1925 | Longvall | |
| 1,578,488 | A * | 3/1926 | Walker | 242/128 |
| 2,021,032 | A | 11/1935 | Swanson | |
| 2,602,606 | A | 7/1952 | Hanse | |
| 2,809,791 | A * | 10/1957 | Haworth | 242/128 |
| 2,851,228 | A | 9/1958 | Keck | |
| 2,942,802 | A | 6/1960 | Bachus | |
| 3,073,545 | A | 1/1963 | Frate et al. | |
| 3,150,845 | A | 9/1964 | Pool | |
| 3,175,784 | A | 3/1965 | Dambrogio | |
| 3,315,917 | A | 4/1967 | Brown | |
| 3,428,269 | A | 2/1969 | Horwood et al. | |
| 3,637,155 | A | 1/1972 | Pato | |
| 4,074,871 | A | 2/1978 | Stotler | |
| 4,100,721 | A | 7/1978 | Seiichi et al. | |
| 4,180,218 | A | 12/1979 | Jacobs | |
| 4,235,393 | A | 11/1980 | Schenkel et al. | |
| 4,298,174 | A | 11/1981 | Kovaleski | |
| 4,402,467 | A | 9/1983 | Kontz | |
| 4,515,328 | A | 5/1985 | Payne, Jr. | |
| 4,673,140 | A | 6/1987 | Boles | |
| 4,687,151 | A * | 8/1987 | Memminger et al. | 242/420.5 |

(Continued)

FOREIGN PATENT DOCUMENTS

| | | |
|---|---|---|
| BE | 1 009 581 A3 | 5/1997 |
| CH | 223 815 A | 10/1942 |

(Continued)

OTHER PUBLICATIONS

12294 International Search Report, date Mar. 6, 2013, 12 pages.*

(Continued)

*Primary Examiner* — William E Dondero
(74) *Attorney, Agent, or Firm* — Sarah M. DeCristofaro; Charles R. Matson; Charles R. Ware

(57) ABSTRACT

An apparatus with a rotatable arm for unwinding a strand by taking it off of the side of a wound package.

16 Claims, 9 Drawing Sheets

(56) References Cited

U.S. PATENT DOCUMENTS

| | | | | |
|---|---|---|---|---|
| 5,692,698 | A | | 12/1997 | Forbes |
| 5,709,354 | A | | 1/1998 | Blandin et al. |
| 5,749,210 | A | * | 5/1998 | Kikuchi et al. ..... 57/58.49 |
| 5,975,457 | A | | 11/1999 | Forbes |
| 6,076,763 | A | | 6/2000 | Sparafora |
| 6,345,783 | B1 | | 2/2002 | Worner |
| 6,386,477 | B1 | | 5/2002 | Kaufmann et al. |
| 6,533,212 | B1 | | 3/2003 | Tafel, II |
| 6,676,054 | B2 | | 1/2004 | Heaney et al. |
| 6,722,606 | B2 | | 4/2004 | Hanson et al. |
| 6,786,264 | B1 | | 9/2004 | Torres Martinez |
| 6,820,837 | B2 | | 11/2004 | Long |
| 6,923,401 | B2 | | 8/2005 | Lock |
| 7,527,216 | B2 | | 5/2009 | Manning, Jr. et al. |
| 7,540,174 | B2 | | 6/2009 | Snijders |
| 7,621,479 | B2 | | 11/2009 | Matzenmüller |
| 7,806,360 | B2 | | 10/2010 | Chadwick |
| 7,878,447 | B2 | | 2/2011 | Hartzheim |
| 7,887,001 | B2 | | 2/2011 | Yoon et al. |
| 7,896,282 | B2 | | 3/2011 | Barea |
| 7,905,446 | B2 | | 3/2011 | Hartzheim |
| 2004/0104299 | A1 | | 6/2004 | Heaney et al. |
| 2005/0133653 | A1 | | 6/2005 | Heaney et al. |
| 2005/0278914 | A1 | | 12/2005 | Bartkowiak et al. |
| 2006/0131459 | A1 | | 6/2006 | Barea |
| 2011/0042012 | A1 | | 2/2011 | Benner et al. |
| 2011/0127364 | A1 | | 6/2011 | Rees et al. |
| 2012/0217337 | A1 | | 8/2012 | Barea |
| 2013/0161431 | A1 | | 6/2013 | Yanez, Jr. et al. |

FOREIGN PATENT DOCUMENTS

| | | | | |
|---|---|---|---|---|
| DE | 1 972 011 | U | | 11/1967 |
| DE | 1 449 659 | A1 | * | 3/1969 |
| DE | 38 33 434 | C1 | | 12/1989 |
| DE | 102 24 909 | A1 | | 12/2003 |
| EP | 0 045 854 | A1 | | 2/1982 |
| FR | 2 104 228 | A5 | | 4/1972 |
| GB | 598 999 | A | | 3/1948 |
| GB | 2 172 617 | A | | 2/1986 |
| JP | 02 11172 | U | | 1/1990 |
| JP | 06 287843 | A | | 10/1994 |
| JP | H2-38495 | U | | 3/1996 |
| JP | 08 151169 | A | | 6/1996 |
| JP | 2001 025868 | A | | 1/2001 |
| JP | S43-18668 | U | | 8/2009 |
| WO | WO 02/077685 | A1 | | 10/2002 |

OTHER PUBLICATIONS

Over End Take Off Elastic Unwind Systems Equipment Overview, 14 pages, 2005.

* cited by examiner

APPARATUS WITH ROTATABLE ARM FOR UNWINDING STRANDS OF MATERIAL

FIELD

The present disclosure relates to an apparatus for unwinding strands of material from wound packages. In particular, the present disclosure relates to an apparatus with a rotatable arm for unwinding a strand by taking it off of the side of a wound package.

BACKGROUND

Over End Take-Off equipment is used to unwind strands of material that have been pre wound onto cores. The pre-wound cores are called packages. Over End Take-Off equipment unwinds a strand by taking it off over the end of the package. The Over End Take-Off equipment then feeds the unwound strand to downstream equipment.

During the unwinding process, the strand experiences friction as it is being taken off. As a strand is being taken off, the strand may also experience adhesive and/or cohesive forces that stick the strand to the underlying material of the package. Due to friction and sticking forces, the strand resists being taken off over the end of the package. As a result of this resistance, during the unwinding, the strand may experience high tension and/or variable tensions, which make reliable processing more difficult.

Further, as a strand is being taken off, portions of the strand may encounter sticking forces that are quite large, when compared to the strength of the strand. When the strand is taken off over the end of the package, the strand is pulled across the side of the package. When the strand is pulled across the side of the package, the tension in the strand attempts to overcome the sticking forces by shearing the stuck portion away from the side. However, in this mode, the strand may experience a high tension that breaks the strand, resulting in downtime for the equipment.

SUMMARY

Embodiments of the present disclosure use a rotatable arm to unwind a strand by taking it off of the side of a wound package. Using the rotatable arm reduces the friction as the strand is being taken off, which is especially useful for tacky strands. As a result, the strand experiences lower tension with less variability. Using the rotatable arm also tends to peel stuck portions away from the side, so that a lower tension in the strand can overcome the sticking forces. As a result, the strand experiences fewer instances of high tension, which leads to fewer breaks and less downtime for the equipment.

BRIEF DESCRIPTIONS OF DRAWINGS

DETAILED DESCRIPTION

Embodiments of the present disclosure use a rotatable arm to unwind a strand by taking it off of the side of a wound package. Using the rotatable arm reduces the friction as the strand is being taken off, which is especially useful for tacky strands. As a result, the strand experiences lower tension with less variability. Using the rotatable arm also tends to peel stuck portions away from the side, so that a lower tension in the strand can overcome the sticking forces. As a result, the strand experiences fewer instances of high tension, which leads to fewer breaks and less downtime for the equipment.

Embodiments of the present disclosure can be used with all kinds of strands (and bands), of various sizes and shapes, made from different materials. For example, embodiments of the present disclosure can be used to unwind string, elastic, metal wire, etc.

Figure 1A:
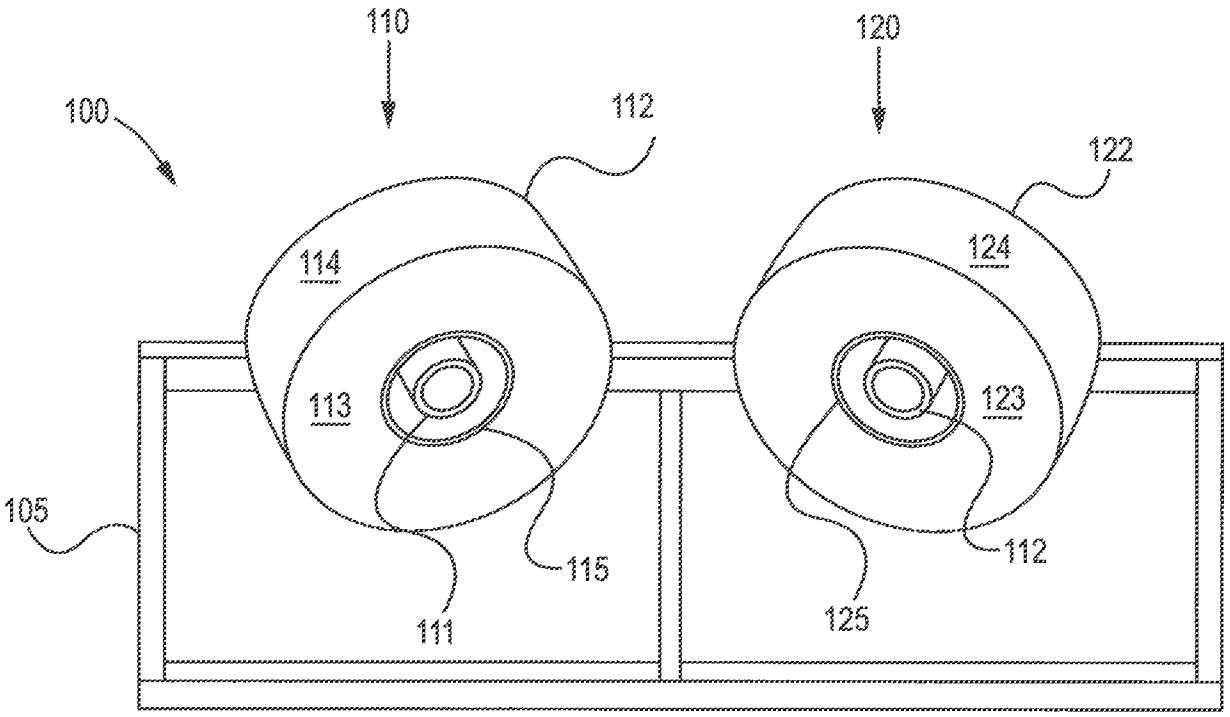
Fig. 1A PRIOR ART
FIG. 1A illustrates a front elevation view of a prior art Over End Take-Off apparatus for unwinding strands of material from wound packages.

FIG. 1A illustrates a front elevation view of a prior art Over End Take-Off apparatus 100 for unwinding strands of material from wound packages. The Over End Take-Off apparatus 100 includes a first package unwind station 110 and a second package unwind station 120, mounted to a frame 105. The first package unwind station 110 includes a first holder 111 for holding a package, and the second package unwind station 120 includes a second holder 112 for holding a package.

In FIG. 1A, a first package 112 is loaded into the first package unwind station 110. The first package 112 includes a strand of material wound onto a cylindrical core 115. The first package 112 also has an overall shape that is cylindrical, with substantially flat ends 113 and a side 114, which is the curved surface around the circumference of the cylindrical shape.

Also, in FIG. 1A, a second package 122 is loaded into the second package unwind station 120. The second package 122 includes a strand of material wound onto a cylindrical core 125. The second package 122 also has an overall shape that is cylindrical, with substantially flat ends 123 and a side 124, which is the curved surface around the circumference of the cylindrical shape.

Figure 1B:
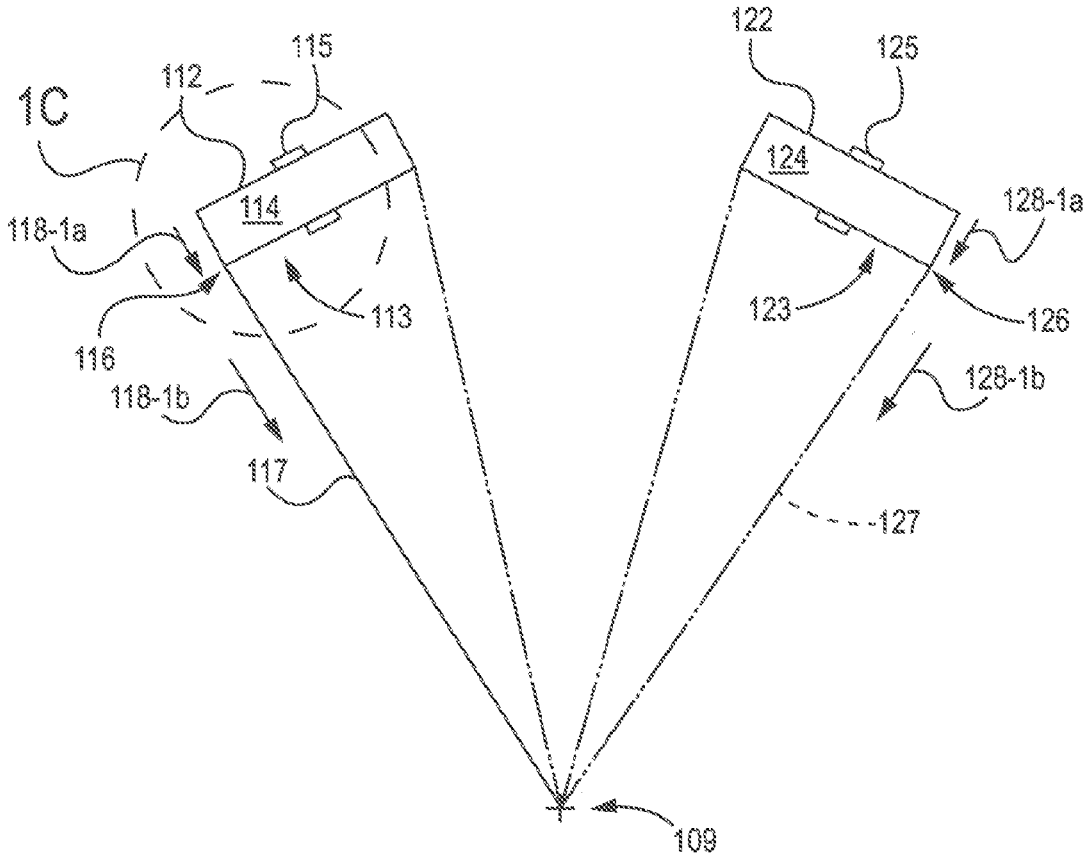
Fig. 1B PRIOR ART
FIG. 1B illustrates a top view of the packages of FIG. 1A, in a prior art Over End Take-Off configuration, for unwinding strands to a downstream infeed location.

FIG. 1B illustrates a top view of the packages 112 and 122 of FIG. 1A, in a prior an Over End Take-Off configuration, for unwinding strands to a downstream infeed location 109. The front ends 113 and 123 of the packages 112 and 122 are angled toward the downstream infeed location 109.

In FIG. 1B, the first package 112 is the active package and the second package 122 is the standby package. In FIG. 1B, the Over End Take-Off apparatus (not shown) is unwinding a first strand 117 of material from the first package 112. Downstream equipment creates process tension in the first strand 117 and pulls the first strand 117 to the downstream infeed 109. As a result, the first strand 117 is pulled across 118-1*a* the side 114 of the first package 112, and the first strand 117 is taken off of the first package 112 in a first take-off direction 118-1*b*, which is a substantially straight line from a take-off point 116 on one side of the outer edge of the front end 113 of the first package 112 to the downstream infeed location 109.

Since the first strand 117 is pre-wound around the cylindrical outer surface of the first package 112, as the first strand 117 is unwound, the take-off point 116 moves in a circular motion, around the outer edge of the front end 113 of the first package 112, and the first take-off direction 118-1*b* follows. From the perspective of the downstream infeed location 109, the first strand 117 may unwind in a clockwise or counterclockwise direction, depending on how the first package 112 is wound and how the first package 112 is loaded into the first package station 110. The extent of the first take-off direction 118-1*b* is indicated by the phantom line that extends from the other side of the outer edge of the front end 113 of the first package 112 to the downstream infeed location 109.

After the second package 122 becomes the active package, the Over End Take-Off apparatus unwinds a second strand 127 of material from the second package 122. Downstream equipment creates process tension in the second strand 127 and pulls the second strand 127 to the downstream infeed 109. As a result, the second strand 127 is pulled across 128-1*a* the side 124 of the second package 122, and the second strand 127 is taken off of the second package 122 in a second take-off direction 128-1*b*, which is a substantially straight line from a take-off point 126 on one side of the outer edge of the front end 123 of the second package 122 to the downstream infeed location 109.

Since the second strand 127 is pre-wound around the cylindrical outer surface of the first package 122, as the second strand 127 is unwound, the take-off point 126 moves in a circular motion, around the outer edge of the front end 123 of the second package 122, and the second take-off direction 128-1*b* follows. From the perspective of the downstream infeed location 109, the second strand 127 may unwind in a clockwise or counterclockwise direction, depending on how the second package 122 is wound and how the second package 122 is loaded into the second package station 120. The extent of the second take-off direction 128-1*b* is indicated by the second phantom line that extends from the other side of the outer edge of the front end 123 of the second package 122 to the downstream infeed location 109.

Figure 1C:
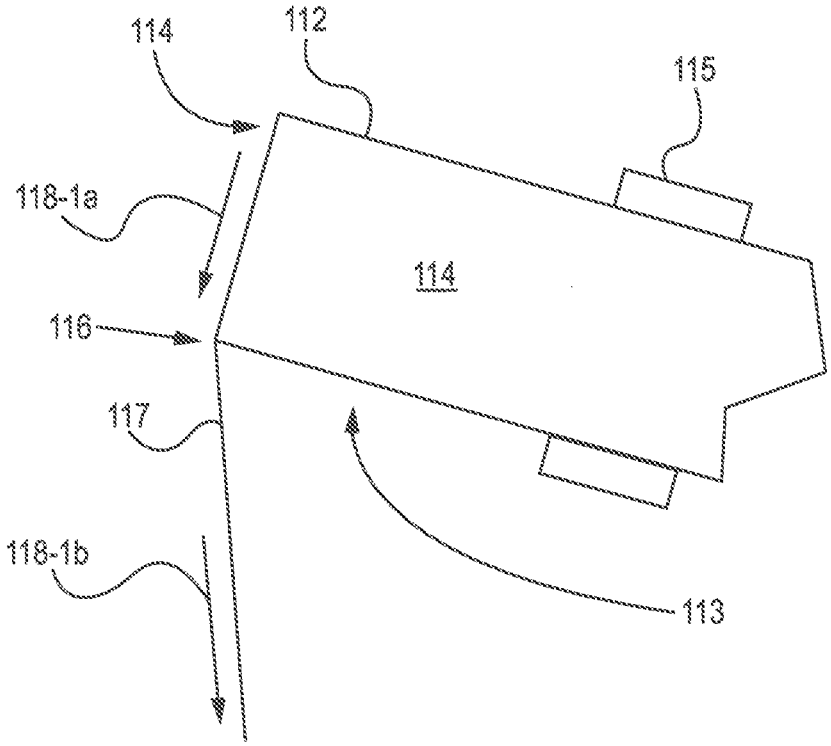
Fig. 1C PRIOR ART
FIG. 1C illustrates an enlarged top view of a portion of one the packages of FIG. 1B, in a prior art Over End Take-Off configuration, for taking a strand off over an end of the package.

FIG. 1C illustrates an enlarged top view of a portion of the first package 112 of FIG. 1B, in a prior art Over End Take-Off configuration, for taking the strand 117 off over the front end 113 of the package.

Figure 2A:
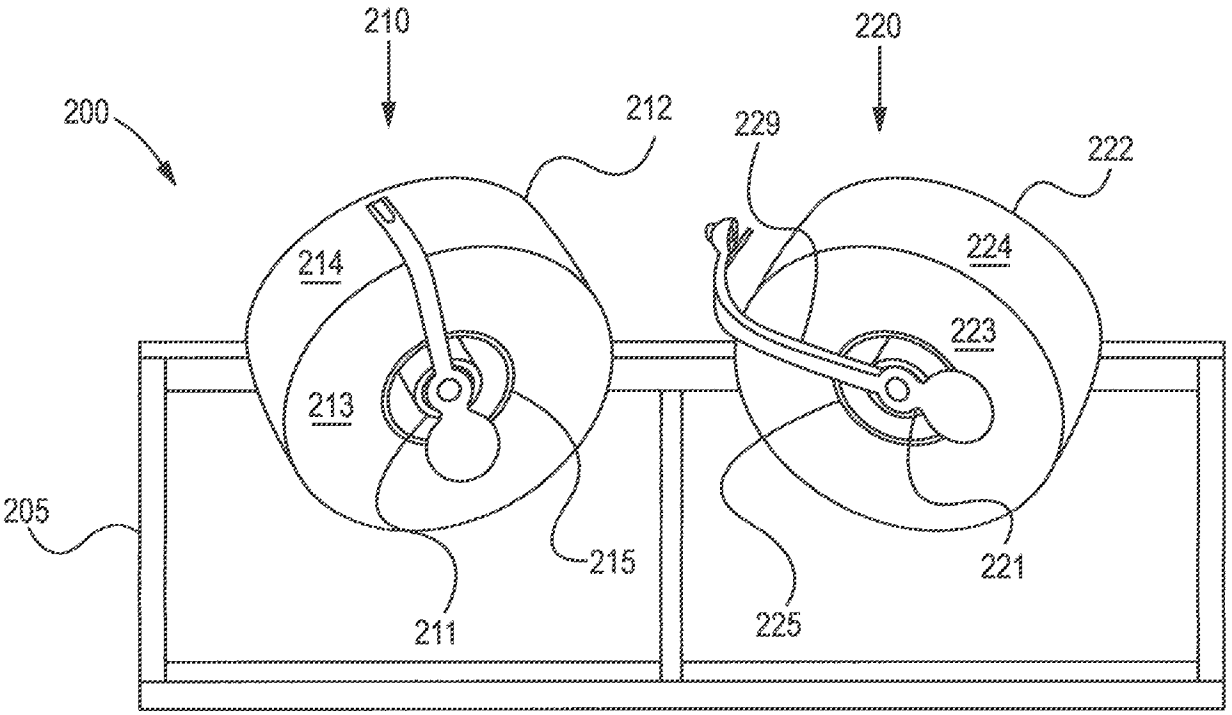
FIG. 2A illustrates a front elevation view of an apparatus for unwinding strands of material from wound packages, wherein the apparatus includes rotatable arms of the present disclosure.

FIG. 2A illustrates a front elevation view of an apparatus 200 for unwinding strands of material from wound packages, wherein the apparatus 200 includes rotatable arms of the present disclosure. The apparatus 200 includes a first package unwind station 210 and a second package unwind station 220, mounted to a frame 205. The first package unwind station 210 includes a first holder 211 for holding a package, and the second package unwind station 220 includes a second holder 221 for holding a package. The first package unwind station 210 includes a first rotatable arm 219, and the second package unwind station 220 includes a second rotatable arm 229. The first arm 219 and the second arm 229 can each configured in the same way as the arm 319 of FIGS. 3A-3D, including any of its alternative embodiments.

In FIG. 2A, a first package 212 is loaded into the first package unwind station 210. The first package 212 includes a strand of material wound onto a cylindrical core 215. The first package 212 also has an overall shape that is cylindrical, with substantially flat ends 213 and a side 214, which is the curved surface around the circumference of the cylindrical shape. The first rotatable arm 219 is configured to unwind a strand from the first package 212 to a downstream infeed location.

Also, in FIG. 2A, a second package 222 is loaded into the second package unwind station 220. The second package 222 includes a strand of material wound onto a cylindrical core 225. The second package 222 also has an overall shape that is cylindrical, with substantially flat ends 223 and a side 224, which is the curved surface around the circumference of the cylindrical shape. The second rotatable arm 229 is configured to unwind a strand from the second package 222 to the downstream infeed location.

Figure 2B:
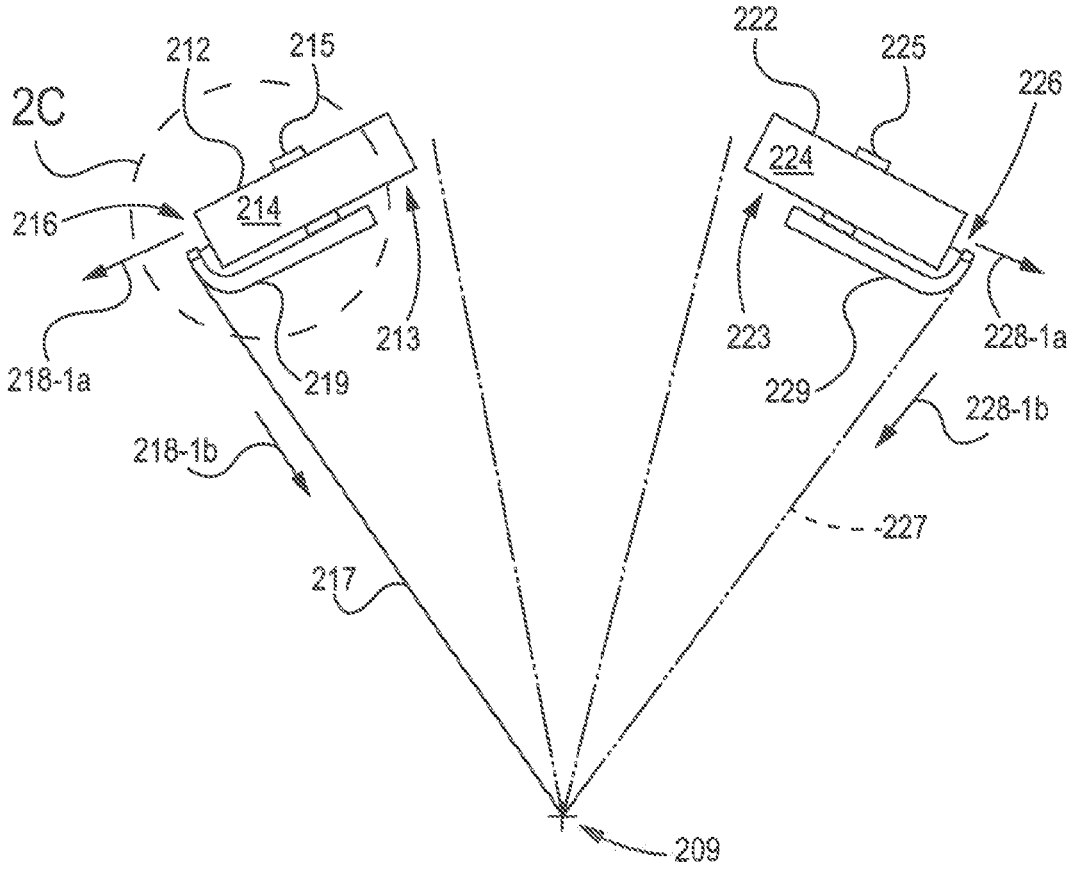
FIG. 2B illustrates a top view of the packages and the rotatable arms of FIG. 2A, configured according to the present disclosure, for unwinding strands to a downstream infeed location.

FIG. 2B illustrates a top view of the packages 212 and 222 and the rotatable arms 219 and 229 of FIG. 2A, configured according to the present disclosure, for unwinding strands to a downstream infeed location 209. The front ends 213 and 223 of the packages 112 and 122 are angled toward the downstream infeed location 209.

In FIG. 2B, the first package 212 is the active package and the second package 222 is the standby package. In FIG. 2B, the apparatus is unwinding a first strand 217 of material from the first package 212. Downstream equipment creates process tension in the first strand 217 and pulls the first strand 217 to the downstream infeed 209. Strand guides on the first rotatable arm 219 constrain and direct the path of the strand 217 between the first package 212 and the downstream infeed 209. As a result, the first strand 217 is taken off of the first package 212 from a take-off point 216 on the side 214 of the first package 212. From the takeoff point 216, the first strand 217 is pulled up and away from the side 214 in a first take-off direction 218-1*a*, and over the strand guides on the first rotatable arm 219. After the first strand 217 leaves the strand guides on the first rotatable arm 219, the first strand 217 is directed in a first infeed direction 218-1*b*, which is a substantially straight line from a downstream strand guide on the first rotatable arm 219 to the downstream infeed location 109.

Since the first strand 217 is pre-wound around the cylindrical outer surface of the first package 212, as the first strand 217 is unwound, the take-off point 216 moves in a spiral motion, around the side 214 of the first package 212, and the first rotatable arm 219 follows with a circular motion. From the perspective of the downstream infeed location 209, the first strand 217 may unwind in a clockwise or counterclockwise direction, depending on how the first package 212 is wound and how the first package 212 is loaded into the first package station 210. The strand guides on the first rotatable arm 219 are configured to unwind in either the clockwise or counterclockwise direction. The extent of the first infeed direction 218-1*b* is indicated by the phantom line that extends from the opposite part of the side 214 of the first package 212 to the downstream infeed location 209.

After the second package 222 becomes the active package, the apparatus unwinds a second strand 227 of material from the second package 222. Downstream equipment creates process tension in the second strand 227 and pulls the second strand 227 to the downstream infeed 209. Strand guides on the second rotatable arm 229 constrain and direct the path of the strand 227 between the second package 222 and the downstream infeed 209. As a result, the second strand 227 is taken off of the second package 222 from a take-off point 226 on the side 224 of the second package 222. From the take-off point 226, the second strand 227 is pulled up and away from the side 224 in a first take-off direction 228-1*a*, and over the strand guides on the second rotatable arm 229. After the second strand 227 leaves the strand guides on the second rotatable arm 229, the second strand 227 is directed in a second infeed direction 228-1*b*, which is a substantially straight line from a downstream strand guide on the second rotatable arm 229 to the downstream infeed location 209.

Since the second strand 227 is pre-wound around the cylindrical outer surface of the second package 222, as the second strand 227 is unwound, the take-off point 226 moves in a spiral motion, around the side 224 of the second package 222, and the second rotatable arm 229 follows with a circular motion. From the perspective of the downstream infeed location 209, the second strand 227 may unwind in a clockwise or counterclockwise direction, depending on how the second package 222 is wound and how the second package 222 is loaded into the second package station 220. The strand guides on the second rotatable arm 229 are configured to unwind in either the clockwise or counterclockwise direction. The extent of the second infeed direction 228-1*b* is indicated by the phantom line that extends from the opposite part of the side 224 of the second package 222 to the downstream infeed location 209.

Figure 2C:
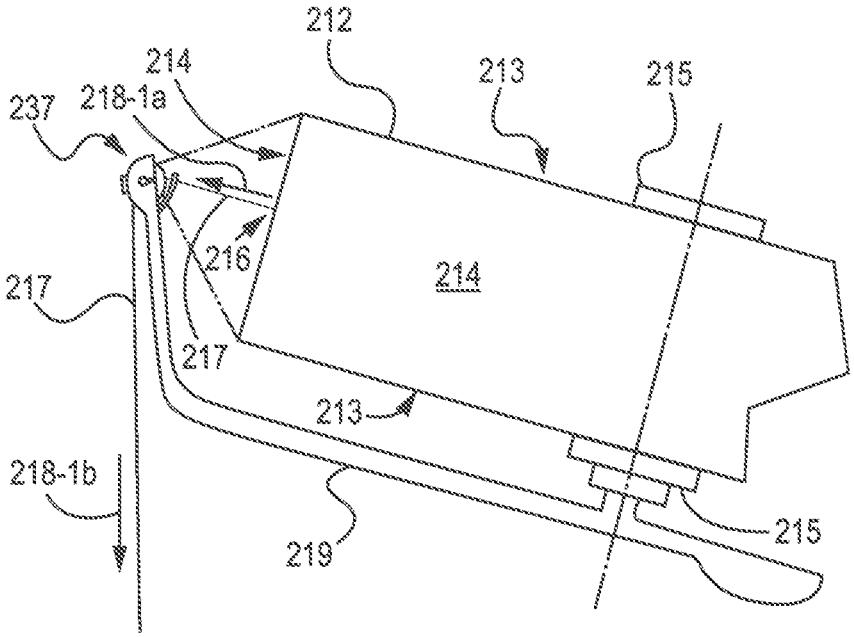
FIG. 2C illustrates an enlarged top view of a portion of one the packages and one of the rotatable arms of FIG. 2B, configured according to the present disclosure, for taking a strand off a side of the package.

FIG. 2C illustrates an enlarged top view of a portion of the first package 212 and the first rotatable arm 219 of FIG. 2B, for taking the first strand 217 off the side 214 of the first package 212. The strand guides of the first rotatable arm 219 are disposed in a head 237 of the first rotatable arm 219. When the first rotatable arm 219 is in position at the first package unwind station 210, the head 237 (and the strand guides) of the first rotatable arm 219 are offset from the outer surface of the package 212, radially outward from the side 214.

The first strand 217 is taken off of the first package 212 from a take-off point 216 on the side 214 of the first package 212. From the take-off point 216, the first strand 217 is pulled up and off of the side 214 in the first take-off direction 218-1*a*, which extends radially outward from the centerline of the first package 212.

Since the first strand 217 is pre-wound around the first package 222, back and forth from the front end 213 to the back end 213, as the first strand 217 is unwound, the take-off point 216 moves in an oscillating motion, back and forth across the side 214 of the first package 212, and the first take-off direction 218-1*a* follows. The extent of the first take-off direction 218-1*a* is indicated by the phantom lines that extend from the front and back edges of the side 214 of the first package 212 to the strand guides on the head 237 of the first rotatable arm 219.

As shown by the phantom lines in FIG. 2C, the orientation of the first take-off direction 218-1*a* can vary with respect to the side 214, as the first strand 217 is unwound. However, in each orientation, the first take-off direction 218-1*a* has a significant directional component extending radially outward from the centerline of the first package 212. That is, despite the movement of the take-off point 216, due to the location of the head 237 and the circular motion of the first rotatable arm 219, the first strand 217 is always being pulled up and off of the side 214.

In the embodiment of FIG. 2C, the head 237 of the rotatable arm 219 is shown about halfway between the front 213 and the back 213 of the first package 214; however, this particular position is not required. In various embodiments, the length of the rotatable arm 219 can be selected to position the head 237 closer to the front 213 or closer to the back 213. In a particular exemplary embodiment, the head 237 can be positioned proximate to the back 213 of the package 214, so that, during the unwind process, the first strand 217 is less likely to be pulled off the end of the upstream strand guides, as described in connection with FIGS. 3A-3C.

By using the first rotatable arm 219, an apparatus can unwind the first strand 217 by taking it off of the side 214 of the first package 212. When compared with the prior art approach of Over End Take-Off, using the first rotatable arm 219 reduces the friction as the first strand 214 is being taken off, which is especially useful for tacky strands. As a result, the first strand 214 experiences lower tension with less variability, which makes reliable processing less difficult.

Further, by using the first rotatable arm 219, stuck portions of the first strand 217 can be pulled up, off of the side 214 instead of being pulled across the side 214. With the pulling up in the first take-off direction 218-1*a*, the adhesion and/or cohesion of the stuck portions can be peeled away from the side 214 instead of being sheared off of the side 214, to overcome the sticking. As a result, the first strand 214 experiences fewer instances of high tension, which leads to fewer breaks and less downtime for the equipment.

The second rotatable arm 229 is configured in the same way as the first rotatable arm 219, with respect to its structure, function, and benefit.

Figure 3A:
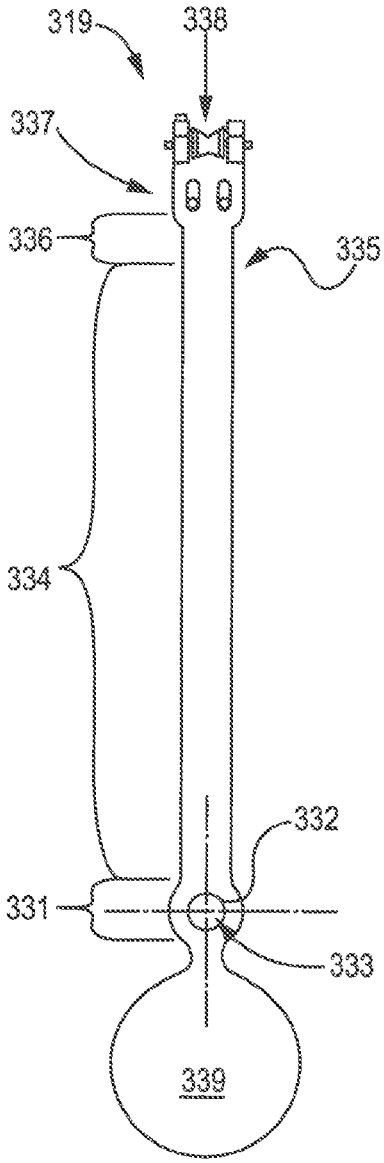
FIG. 3A illustrates a front view of the rotatable arm of FIG. 2A.

FIG. 3A illustrates a front view of a rotatable arm 319, which can be used as either or both of the rotatable arms 219 and 229 of FIGS. 2A-2C. The rotatable arm 319 includes a base 331 with a mounting hole 332, and a rotational axis 333 passing through the center of the mounting hole 332. A first extended portion 334 is attached to one side of the base 331 and a counterbalance 339 is attached to the other side of the base 331. A second extended portion 336 is attached to the first extended portion 334. A bend 335 in the rotatable arm 319 separates the first extended portion 334 from the second extended portion 336, and sets the portions at an angle with respect to each other. The length of the first extended portion 334 and the second extended portion, as well as the angle of the bend 335 can be selected according to the overall dimensions of the packages to be unwound by the rotatable arm 319. The rotating arm 319 can be made from various solid materials that are rigid and sturdy. For example, the rotatable arm 319 can be made from plastic, metal, ceramic, wood, etc.

A head 337 of the rotatable arm 319 is attached to the second extended portion 336. The end of the head 337 terminates at a distal end 338 of the rotatable arm 319. The head 337 of the rotatable arm 319 includes several strand guides, described and illustrated in connection with FIGS. 3C and 3D.

Figure 3B:
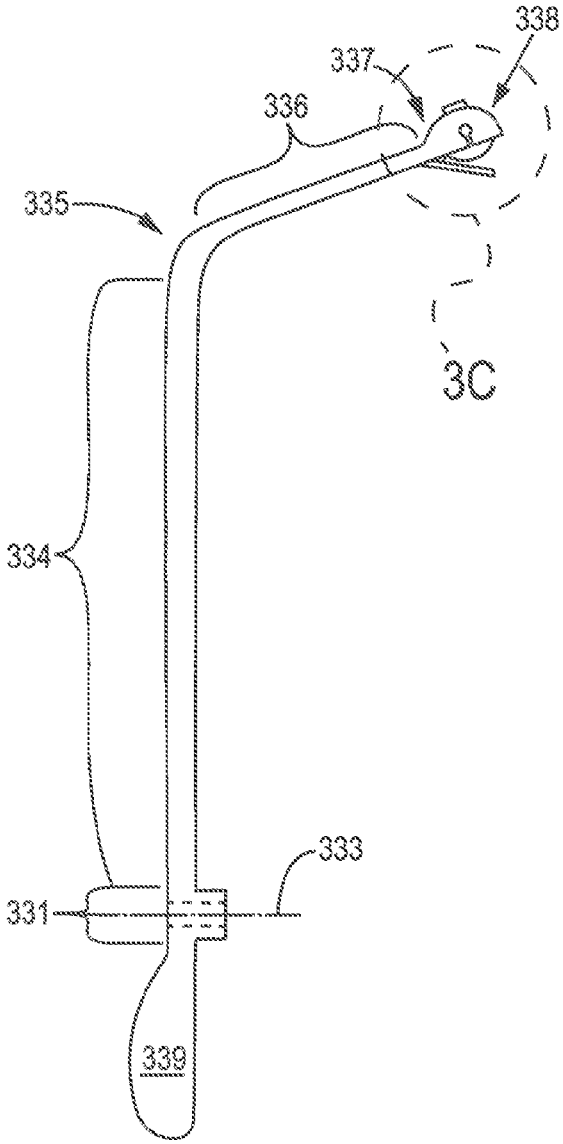
FIG. 3B illustrates a side view of the rotatable arm of FIG. 3A.

FIG. 3B illustrates a side view of the rotatable arm 319 of FIG. 3A. While the rotatable arm 319 is unpowered, in various embodiments, a rotational drag device can be connected to the rotatable arm 319, to control the speed of rotation and to limit over-rotation. For example, magnetic brake can be connected to the rotatable arm, at its base 333. For instance, a magnetic particle brake, such as product MB1-3/16 from Warner Electric, LLC of South Beloit, Ill., USA can be used.

Figure 3C:
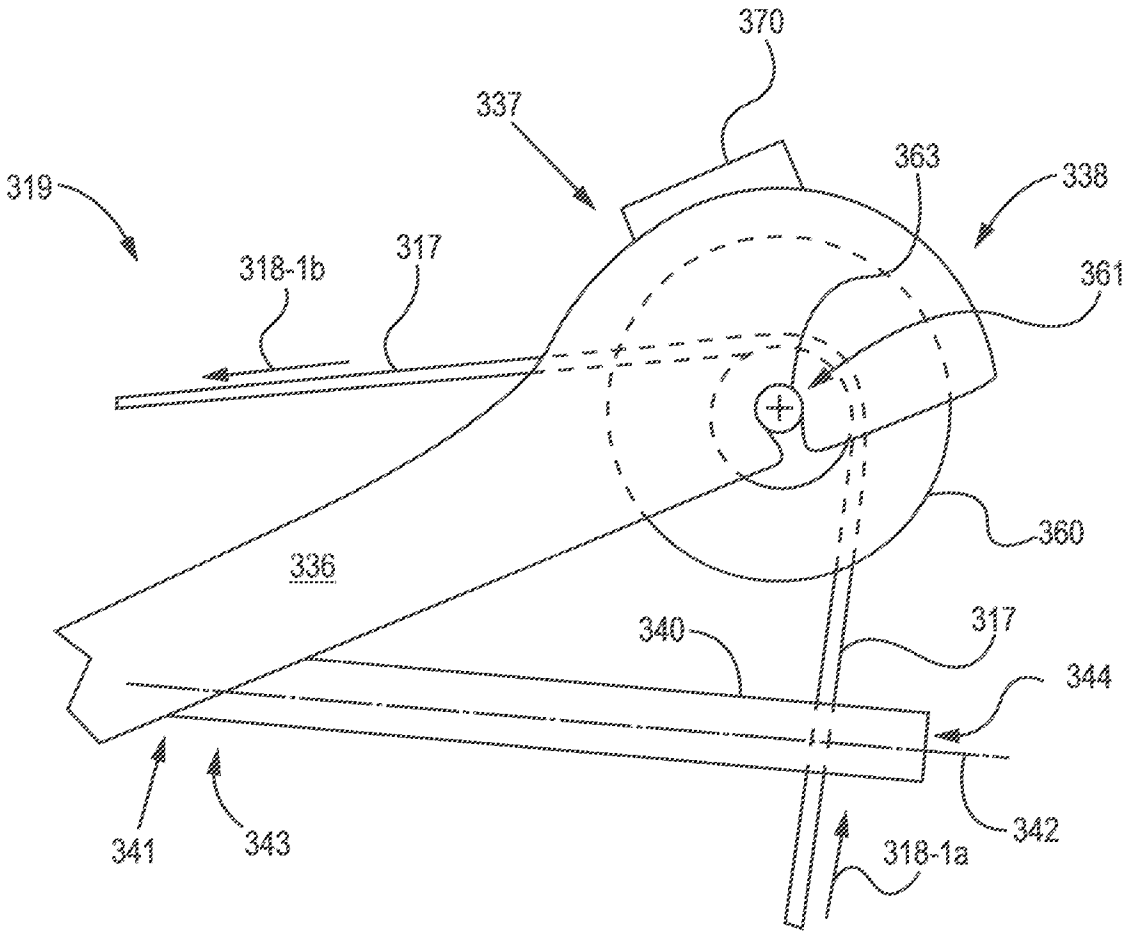
FIG. 3C illustrates an enlarged side view of the head of the rotatable arm of FIG. 3B, taking a strand off a side of a package.

FIG. 3C illustrates an enlarged side view of the head 337 of the rotatable arm 319 of FIG. 3B, taking a strand 317 off a side of a package. The rotatable arm 319 includes a first upstream strand guide 340, a second upstream strand guide (shown in FIG. 3D), and a downstream strand guide 360. The first upstream strand guide 340 and the second upstream strand guide 350 are attached at different locations, but are generally configured in the same way. The rotatable arm 319 is taking off the strand 317 in a take-off direction 318-1*a* and over the strand guides, and is directing the strand 317 in an infeed direction 318-1*b* to a downstream infeed location.

The downstream strand guide 360 is attached to the rotatable arm 319 at a downstream strand guide attachment location 361, which is proximate to the distal end 338 of the rotatable aim 319. The downstream strand guide attachment location 361 is spaced apart from the rotational axis 333 of the rotatable arm 319. The downstream strand guide 360 is an open guide, such that it does not fully constrain the lateral movement of the strand 317. The downstream strand guide 360 is also dynamic guide, configured to rotate in place. In FIG. 3C, the downstream strand guide 360 is a grooved wheel, configured to rotate around a shaft 363.

The first upstream strand guide 340 is also an open guide. A proximal end 343 of the first upstream strand guide 340 is attached to the rotatable arm 319 at a first upstream strand guide attachment location 341, that is closer to the rotational axis 333 than the downstream strand guide attachment location 361. The first upstream strand guide 340 is disposed proximate to the downstream strand guide 360. The downstream strand guide 340 is a static guide, not configured to rotate in place.

The first upstream strand guide 340 has a distal end 344 that is free, which allows the strand 317 to slide off of the distal end 344 without obstruction. The first upstream strand guide 340 has an overall shape that is elongated from the proximal end 343 to the distal end 344. In FIG. 3C, the overall shape of the first upstream strand guide 340 is cylindrical, however, in various embodiments, an upstream strand guide can be configured with other shapes. The first upstream strand guide 340 has an upstream strand guide centerline 342, following the longitudinal axis of the cylindrical shape. The upstream strand guide centerline 342 is parallel with the rotational axis 333.

The strand guides can be made from various solid materials that are hard and low friction, with a low surface porosity. For example, the strand guides can be made from plastic, metal, ceramic, etc. For instance, for a downstream strand guide, a ceramic idler, such as part #Z-238 from Yuasa can be used.

A ferrous material 370 is optionally attached to the rotatable arm 319, so that the rotatable arm 370 can be held in place by a magnet. In FIG. 3C, the ferrous material 370 is attached to the rotatable arm 370 at a location that is proximate to the distal end 338. Alternatively, the rotatable arm 319 can include a ferrous material as part of a component of the arm. For example, the downstream strand guide 360 can include a bearing made from a ferrous material.

Figure 3D:
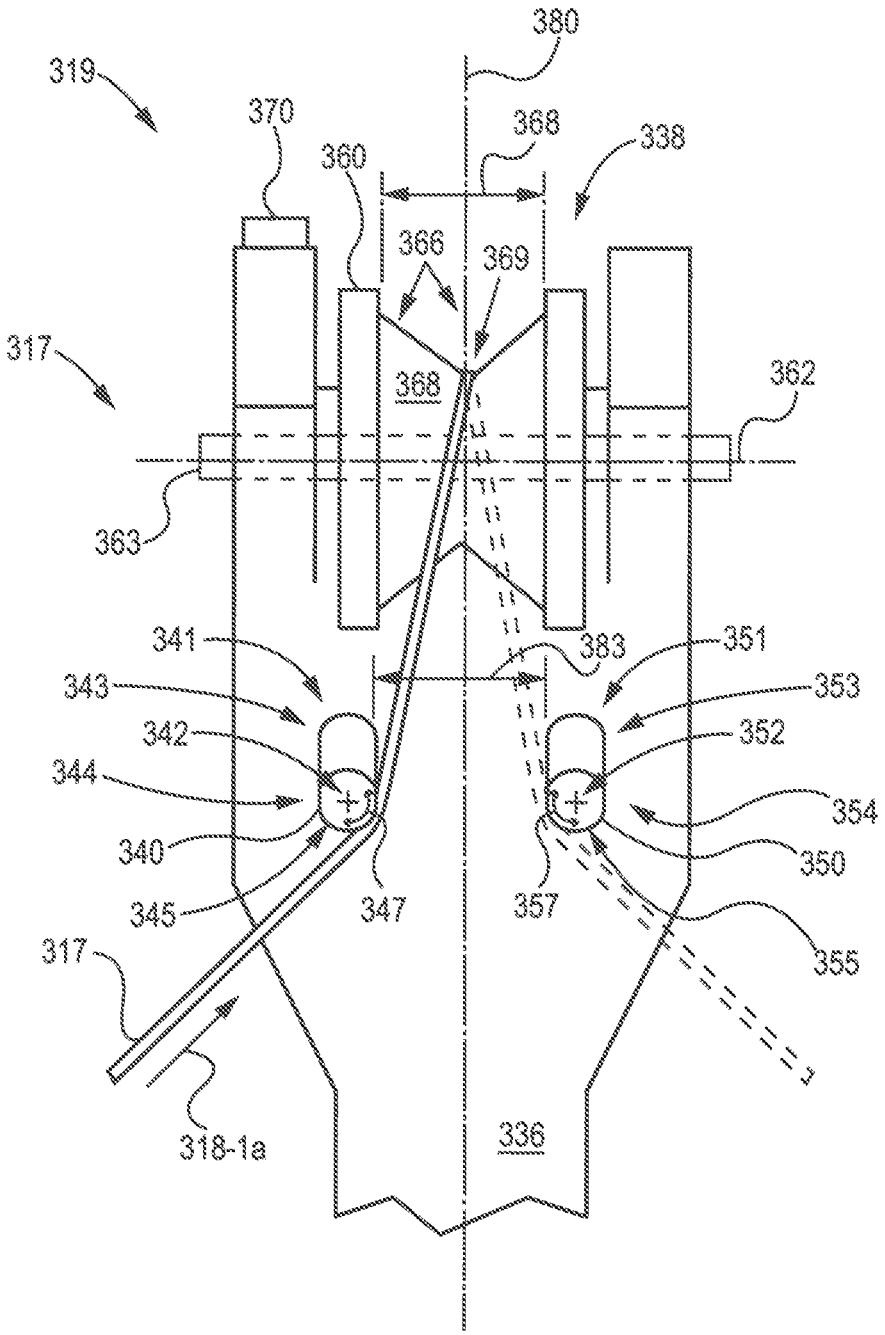
FIG. 3D illustrates an enlarged front view of the head of the rotatable arm of FIG. 3C, taking a strand off a side of a package.

FIG. 3D illustrates an enlarged front view of the head 337 of the rotatable arm 319 of FIG. 3C, taking the strand 317 off a side of a package.

FIG. 3D includes a downstream strand guide reference plane 380 oriented parallel to the groove 366 of the downstream strand guide 360. In the embodiment of FIG. 3D, the groove 366 is illustrated as a V-shaped groove, however, in various embodiments, the groove 366 can be a smooth curve, or other shapes known in the art. The downstream strand guide reference plane 380 passes through a deepest part 369 of the groove 366. The downstream strand guide reference plane 380 is also parallel with the rotational axis 333. In the embodiment of FIG. 3D, the reference plan 380 passes through the rotational axis 333.

The first upstream strand guide 340 has a first outer surface 345 that is disposed on a first side of the downstream strand guide reference plane 380. The first outer surface 345 has a curve 347 that has a radius with respect to the first upstream strand guide centerline 342.

The second upstream strand guide 350 is attached to the rotatable arm 319 at a second upstream strand guide attachment location 351. The second upstream strand guide 350 is disposed proximate to the downstream strand guide 360. The second upstream strand guide 350 is also an open guide. The second upstream strand guide 350 has a second outer surface 355 that is disposed on a second side of the downstream strand guide reference plane 380. The second upstream strand guide 350 has a curve 357 that has a radius with respect to a second upstream strand guide centerline 352. Each of the upstream strand guide centerlines 342 and 352 is substantially parallel to the downstream strand guide reference plane 380. Also, when the rotatable arm 319 is in its in-use position at a package unwind station, both of the upstream strand guide centerlines 342 and 352 are substantially parallel to the side of the package being unwound.

As used herein, when the word substantially is applied to parallel directions, the word substantially means parallel within 0-30', or any integer value within this range. As used herein, when the word substantially is applied to perpendicular directions, the word substantially means perpendicular within 0-30°, or any integer value within this range.

In FIG. 3D, all of the first upstream strand guide 340 is disposed on the first side of the downstream strand guide reference plane 380 and all of the second upstream strand guide 350 is disposed on the second side of the downstream strand guide reference plane 380, however, in various embodiments, this is not required. Also, with respect to the downstream strand guide reference plane 380, the first upstream strand guide attachment location 341 is symmetrical to the second upstream strand guide attachment location 351, however, in various embodiments, this is not required.

The downstream strand guide 360 is a grooved wheel, configured to rotate around a cylindrical shaft 363, with a centerline 362. The centerline 362 is perpendicular to the reference plane 380 and also perpendicular to each of the upstream strand guide centerlines 342 and 352.

The downstream strand guide 360 has a strand contact surface 365, which is the portion of its curved outer surface that is configured for contact with the strand 317 as the strand 317 is being unwound. The strand contact surface 365 has an overall width 368. The first upstream strand guide attachment location 341 and the second upstream strand guide attachment location 351 are selected such that the first outer surface 345 is spaced apart from the second outer surface 355 by a distance 383 that is less than or equal to the overall width 368.

Since the rotatable arm 319 has a first upstream strand guide 340 and a second upstream strand guide 350, positioned and configured as described above, the rotatable arm 319 can take off the strand 317 in a first orientation with the take-off direction 318-1*a* (constrained by the first outer surface 345) or the rotatable arm 319 can take off the strand 317 in a second orientation (shown in FIG. 3D by phantom lines) with another take-off direction (constrained by the second outer surface 355). Whether taking the strand 317 off in the first orientation or the second orientation, the strand guides of the rotatable arm 319 are configured to direct the strand 317 over the downstream strand guide 360 to the downstream infeed location. Thus, with respect to the downstream infeed location, the rotatable arm 319 can be used to unwind a package in either a clockwise or a counterclockwise direction. As a result, the same rotatable arm 319 can be used to unwind packages regardless of how a package is wound or how a package is loaded into the package station.

It is also contemplated that embodiments of the present disclosure can be combined with other structures and features of take-off devices, which are known in the art. For example, it is contemplated that the apparatus 200 of FIG. 2A can use a splicing apparatus as described in US patent application entitled "Splicing Apparatus for Unwinding Strands of Material" filed on Nov. 4, 2011 by The Procter & Gamble Company under attorney docket number (TBD) in the name of Castillo, et al., which is hereby incorporated by reference.

Embodiments of the present disclosure use a rotatable arm to unwind a strand by taking it off of the side of a wound package. Using the rotatable arm reduces the friction as the strand is being taken off, which is especially useful for tacky strands. As a result, the strand experiences lower tension with less variability. Using the rotatable arm also tends to peel stuck portions away from the side, so that a lower tension in the strand can overcome the sticking forces. As a result, the strand experiences fewer instances of high tension, which leads to fewer breaks and less downtime for the equipment.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An apparatus for unwinding a strand of material, the apparatus comprising:

a frame;

a first package unwind station and a second package unwind station mounted to the frame, wherein each of the first package unwind station and the second package unwind station comprises:

a rotatable arm that includes a base, a rotational axis at the base, and an arm distal end;

a downstream strand guide attached to the rotatable arm at a downstream strand guide attachment location that is spaced apart from the rotational axis, and proximate to the arm distal end, wherein the downstream strand guide is an open guide, and the downstream strand guide includes an outer surface with a groove;

a downstream strand guide reference plane oriented parallel to the groove, passing through a deepest part of the groove and substantially parallel with the rotational axis, with one side of the downstream strand guide reference plane defined as a first side, and another side of the downstream strand guide reference plane defined as a second side;

a first upstream strand guide attached to the rotatable arm at a first upstream strand guide attachment location, wherein the first upstream strand guide is disposed proximate to the downstream strand guide, the first upstream strand guide is an open guide, the first upstream strand guide has a first outer surface that is disposed on the first side of the downstream strand guide reference plane, and the first upstream strand guide has a curve that has a radius with respect to a first upstream strand guide centerline, and wherein the first upstream strand guide is static; and a second upstream strand guide attached to the rotatable arm at a second upstream strand guide attachment location, wherein the second upstream strand guide is disposed proximate to the downstream strand guide, the second upstream strand guide is an open guide, the second upstream strand guide has a second outer surface that is disposed on the second side of the downstream strand guide reference plane, and the second upstream strand guide has a curve that has a radius with respect to a second upstream strand guide centerline, and wherein the second upstream strand guide is static;

wherein each of the upstream strand guide centerlines is substantially parallel to the downstream strand guide reference plane and substantially parallel to the rotational axis, and wherein the first package unwind station is configured to receive a first package and the second unwind station is configured to receive a second package, each of the first package and the second package include a front end, and wherein the front end of the first package is angled with respect to the front end of the second package.

2. The apparatus of claim 1, wherein the arm is an unpowered arm.

3. The apparatus of claim 1, wherein the downstream strand guide is a dynamic guide.

4. The apparatus of claim 3, wherein the groove has a curve that has a radius with respect to a downstream strand guide centerline.

5. The apparatus of claim 4, wherein the downstream strand guide is a grooved wheel.

6. The apparatus of claim 1, wherein the downstream strand guide attachment location is disposed proximate to the arm distal end.

7. The apparatus of claim 1, wherein each of the upstream strand guides has an upstream strand guide proximal end attached to the rotatable arm and an upstream strand guide distal end that is free.

8. The apparatus of claim 7, wherein each of the upstream strand guides has an overall shape that is elongated from its proximal end to its distal end.

9. The apparatus of claim 8, wherein each of the upstream strand guides has a cylindrical shape.

10. The apparatus of claim 1, wherein each of the upstream strand guide centerlines is completely parallel to the groove.

11. The apparatus of claim 1, wherein all of the first upstream strand guide is disposed on the first side of the downstream strand guide reference plane and all of the second upstream strand guide is disposed on the second side of the downstream strand guide reference plane.

12. The apparatus of claim 1, wherein the downstream strand guide has a strand contact surface with an overall width and the first outer surface is spaced apart from the second outer surface by a distance that is less than or equal to the overall width.

13. The apparatus of claim 1, wherein, with respect to the downstream strand guide reference plane, the first upstream strand guide attachment location is symmetrical to the second upstream strand guide attachment location.

14. The apparatus of claim 13, including a ferrous material attached to the arm at a location that is proximate to the arm distal end.

15. The apparatus of claim 1, wherein the arm includes a counterbalance opposite from the arm distal end.

16. A method for unwinding a strand of material, the method comprising:

providing the apparatus of claim 1;

using the first package unwind station to unwind a first strand from the first package, in a clockwise direction with respect to the downstream infeed location; and using the second package unwind station to unwind a second strand from the second package, in a counter-clockwise direction with respect to the downstream infeed location.

* * * * *